US010870556B2

(12) United States Patent
Mahoney

(10) Patent No.: US 10,870,556 B2
(45) Date of Patent: Dec. 22, 2020

(54) METHOD AND SYSTEM FOR DETECTING ELEVATOR CAR OPERATING PANEL CONDITION

(71) Applicant: OTIS ELEVATOR COMPANY, Farmington, CT (US)

(72) Inventor: Sally Day Mahoney, New Hartford, MI (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 474 days.

(21) Appl. No.: 15/839,169

(22) Filed: Dec. 12, 2017

(65) Prior Publication Data

US 2019/0177122 A1 Jun. 13, 2019

(51) Int. Cl.
*B66B 5/00* (2006.01)
*B66B 3/00* (2006.01)
*B66B 1/46* (2006.01)

(52) U.S. Cl.
CPC ..... *B66B 5/0025* (2013.01); *B66B 1/466* (2013.01); *B66B 3/002* (2013.01); *B66B 5/0037* (2013.01)

(58) Field of Classification Search
CPC ..... B66B 5/0025; B66B 5/0037; B66B 3/002; B66B 1/466
USPC ..... 187/393
See application file for complete search history.

(56) References Cited

U.S. PATENT DOCUMENTS 6,575,583 B2 * 6/2003 Suzuki ..... G01D 11/28 362/23.02
6,681,899 B1 * 1/2004 Hong ..... B66B 3/02 187/391
7,837,013 B2 11/2010 Amano
8,896,216 B2 * 11/2014 Lee ..... H05B 45/44 315/153
9,387,798 B2 * 7/2016 Mauderer ..... B60T 7/22
9,667,929 B2 * 5/2017 Yang ..... H04N 9/3182
9,743,490 B1 * 8/2017 Li ..... H05B 47/11
10,176,385 B2 * 1/2019 Brunn ..... G06K 9/00791
10,504,400 B2 * 12/2019 Wang ..... G06T 5/003
(Continued)

FOREIGN PATENT DOCUMENTS

CN 101357726 A 2/2009
CN 102730509 10/2012
(Continued)

OTHER PUBLICATIONS

Extended European Search Report for Application No. EP 18 21 1775 dated May 15, 2019.

*Primary Examiner* — David S Warren
(74) *Attorney, Agent, or Firm* — Carlson, Gaskey & Olds

(57) ABSTRACT

An illustrative example method of determining a condition of an elevator car operating panel includes controlling a plurality of light sources of the car operating panel to turn on all of the light sources. An image of the car operating panel is obtained that indicates an actual illumination of all of the light sources, respectively. A determination is made, based on the obtained image, if there are any differences between an expected illumination and the actual illumination of any of the light sources. An indication of the condition of the elevator car operating panel is provided that includes information regarding any determined differences between the expected illumination and the actual illumination.

18 Claims, 3 Drawing Sheets

(56) References Cited

U.S. PATENT DOCUMENTS

2001/0024361 A1* 9/2001 Suzuki ..... G01D 11/28 362/23.02
2004/0011595 A1* 1/2004 Hong ..... B66B 3/02 187/391
2007/0107992 A1* 5/2007 Fujita ..... B66B 1/34 187/391
2008/0024409 A1* 1/2008 Tomizawa ..... G09G 3/3648 345/88
2008/0198117 A1* 8/2008 Kumakura ..... G09G 3/3648 345/89
2008/0317382 A1* 12/2008 Franz ..... G06T 3/0081 382/294
2009/0040196 A1* 2/2009 Duckstein ..... B60K 37/06 345/204
2012/0044066 A1* 2/2012 Mauderer ..... G08G 1/161 340/479
2013/0144121 A1* 6/2013 St. George ..... A61B 1/00006 600/109
2014/0316197 A1* 10/2014 St. George ..... A61B 1/00036 600/109
2015/0123781 A1* 5/2015 Mauderer ..... B60T 17/22 340/479
2016/0269701 A1* 9/2016 Guo ..... H04N 9/3155
2016/0347235 A1* 12/2016 Brunn ..... G06K 9/00791
2017/0076300 A1* 3/2017 Cavalcanti ..... G06Q 50/26
2017/0197807 A1* 7/2017 Noda ..... G06K 9/00335
2018/0158434 A1* 6/2018 Bian ..... G09G 3/006
2018/0160516 A1* 6/2018 Kwak ..... H05B 45/10
2018/0238815 A1* 8/2018 Mupende ..... G01N 21/952
2018/0304807 A1* 10/2018 Boesch ..... G06K 9/00825
2019/0112152 A1* 4/2019 Kujala ..... G01N 21/8851
2019/0177122 A1* 6/2019 Mahoney ..... B66B 3/002
2019/0237008 A1* 8/2019 Ho ..... G09G 3/3233
2019/0244446 A1* 8/2019 Murzyn ..... B60K 35/00
2020/0011674 A1* 1/2020 Fanselow ..... G01C 21/206
2020/0031284 A1* 1/2020 Onica ..... B60R 1/002
2020/0102188 A1* 4/2020 Holey ..... B66B 5/0025
2020/0118259 A1* 4/2020 Mahadevappa ..... B66B 7/1238
2020/0126497 A1* 4/2020 Wang ..... G09G 3/36

FOREIGN PATENT DOCUMENTS

CN 202670946 U 1/2013
CN 104176581 A 12/2014
CN 104229574 A 12/2014
CN 105491352 A 4/2016
EP 3473574 A1 4/2019
JP 10139317 5/1998
JP 2002308545 A 10/2002
JP 2003040541 A 2/2003
JP 2004345777 A 12/2004
JP 2011011872 A 1/2011
JP 2011068440 A 4/2011
JP 2013155019 8/2013
JP 2015016942 A 1/2015
JP 2016060565 A 4/2016

* cited by examiner

METHOD AND SYSTEM FOR DETECTING ELEVATOR CAR OPERATING PANEL CONDITION

BACKGROUND

Elevator systems include cars for carrying passengers among various levels within a building, for example. Many elevator cars include a car operating panel (COP) inside the cab. Typical COPs include floor selection buttons that allow passengers to indicate their desired destinations, respectively.

Car operating panels typically include a plurality of light sources to illuminate various features of the COP. For example, when a floor selection button is pressed, a light associated with that button is illuminated to provide visual feedback to the passenger that the call has been placed within the elevator system. Floor or position indicators may be lit to provide an indication of the current floor or position of the elevator car to those within the car. Other indicators or buttons on the COP may include a light or illumination source. For example, an indicator for a fire service operation may be lit under appropriate circumstances.

Building owners and elevator service providers prefer that COPs be in proper working condition. One approach at ensuring that the COP light sources are functioning properly involves taking the elevator car out of service temporarily to perform a visual inspection of the light sources of the COP. A drawback associated with this approach is that it reduces the available elevators for carrying passengers within the building and requires the expense of sending a service technician to the site of the elevator system to perform the inspection. Other techniques include adding circuitry for testing current levels on various portions of the COP to detect any malfunctioning components of the COP. Additional monitoring circuits introduce additional expense for the COP and, in some cases, potential for the monitoring circuit, itself, to malfunction.

SUMMARY

An illustrative example method of determining a condition of an elevator car operating panel includes controlling light sources of the car operating panel to turn on all of the light sources. An image of the car operating panel is obtained that indicates an actual illumination of all of the light sources, respectively. A determination is made, based on the obtained image, if there are any differences between an expected illumination and the actual illumination of any of the light sources. An indication of the condition of the elevator car operating panel is provided that includes information regarding any determined differences between the expected illumination and the actual illumination.

In an example embodiment having one or more features of the method of the previous paragraph, the determining comprises comparing the obtained image to a reference image and the reference image indicates the expected illumination of all of the light sources, respectively.

In an example embodiment having one or more features of the method of any of the previous paragraphs, the determining comprises recognizing the expected illumination of at least one of the light sources in at least a first portion of the obtained image, comparing at least a second portion of the obtained image to the first portion, and determining whether at least one light source in the second portion has the expected illumination based on the comparing.

In an example embodiment having one or more features of the method of any of the previous paragraphs, the light source in the second portion has a similar characteristic to the light source in the first portion.

In an example embodiment having one or more features of the method of any of the previous paragraphs, the car operating panel comprises a plurality of floor selection indicators. Some of the light sources are associated with the floor selection indicators, respectively. The car operating panel comprises at least one other elevator function indicator. At least one of the light sources is associated with the other elevator function indicator. The car operating panel includes a car position indicator. Some of the light sources are associated with the car position indicator. Controlling all of the light sources comprises turning on the light sources associated with the floor selection indicators, the elevator function indicator and the car position indicator.

In an example embodiment having one or more features of the method of any of the previous paragraphs, the light sources associated with the car position indicator collectively display a plurality of floor designations based on which of the light sources associated with the car position indicator are illuminated. Controlling all of the light sources includes turning on all of the light sources associated with the car position indicator simultaneously.

In an example embodiment having one or more features of the method of any of the previous paragraphs, the light sources associated with the car position indicator collectively display a plurality of floor designations based on which of the light sources associated with the car position indicator are illuminated. Controlling all of the light sources includes turning on only those of the light sources associated with the car position indicator that should be illuminated to indicate a current car position.

An example embodiment having one or more features of the method of any of the previous paragraphs includes dimming lighting in an elevator cab in which the car operating panel is located prior to obtaining the image.

In an example embodiment having one or more features of the method of any of the previous paragraphs, providing the indication includes identifying any one of the light sources that does not have the expected illumination in the image.

In an example embodiment having one or more features of the method of any of the previous paragraphs, providing the indication includes initiating a request for a technician to attend to the car operating panel when there is a difference between the expected illumination and the actual illumination for any of the light sources.

An illustrative example system includes an elevator car operating panel that has a plurality of light sources. A camera is situated to obtain an image of the car operating panel. The image indicates an actual illumination of all of the light sources, respectively. A controller is configured to control the plurality of light sources, turn on all of the light sources, control the camera to obtain the image when all of the light sources are turned on, determine if there are any differences between an expected illumination and the actual illumination of any of the light sources, and provide an indication of the condition of the elevator car operating panel including information regarding any determined differences between the expected illumination and the actual illumination.

In an example embodiment having one or more features of the system of any of the previous paragraphs, the controller is configured to determine if there are any differences by comparing the obtained image to a reference image and the reference image indicates the expected illumination of all of the light sources, respectively.

In an example embodiment having one or more features of the system of any of the previous paragraphs, the controller is configured to determine if there are any differences by recognizing the expected illumination of at least one of the light sources in at least a first portion of the obtained image, comparing at least a second portion of the obtained image to the first portion, and determining whether at least one light source in the second portion has the expected illumination based on the comparing.

In an example embodiment having one or more features of the system of any of the previous paragraphs, the light source in the second portion has a similar characteristic to the light source in the first portion.

In an example embodiment having one or more features of the system of any of the previous paragraphs, the car operating panel comprises a plurality of floor selection indicators. Some of the light sources are associated with the floor selection indicators, respectively. The car operating panel comprises at least one other elevator function indicator. At least one of the light sources is associated with the other elevator function indicator. The car operating panel includes a car position indicator. Some of the light sources are associated with the car position indicator. The controller is configured to turn on the light sources associated with the floor selection indicators, the elevator function indicator and the car position indicator.

In an example embodiment having one or more features of the system of any of the previous paragraphs, the light sources associated with the car position indicator collectively display a plurality of floor designations based on which of the light sources associated with the car position indicator are illuminated and the controller is configured to turn on all of the light sources associated with the car position indicator simultaneously.

In an example embodiment having one or more features of the system of any of the previous paragraphs, the light sources associated with the car position indicator collectively display a plurality of floor designations based on which of the light sources associated with the car position indicator are illuminated and the controller is configured to turn on only those of the light sources associated with the car position indicator that should be illuminated to indicate a current car position.

An example embodiment having one or more features of the system of any of the previous paragraphs, includes elevator cab lighting. The controller is configured to dim the elevator cab lighting prior to controlling the camera to obtain the image.

In an example embodiment having one or more features of the system of any of the previous paragraphs, the controller is configured to provide the indication including identifying any one of the light sources that does not have the expected illumination in the image.

In an example embodiment having one or more features of the system of any of the previous paragraphs, the controller is configured to initiate a request for a technician to attend to the car operating panel when there is a difference between the expected illumination and the actual illumination for any of the light sources.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention allow for automatically checking the condition or functionality of elevator car operating panel (COP) light sources. Turning on all of a plurality of light sources of the COP and then comparing the actual illumination of those light sources with an expected illumination allows for determining a condition of the light sources of the COP. An indication regarding any differences between the expected and actual illumination of the light sources, respectively, facilitates addressing any need to ensure that the COP is operating properly.

Figure 1:
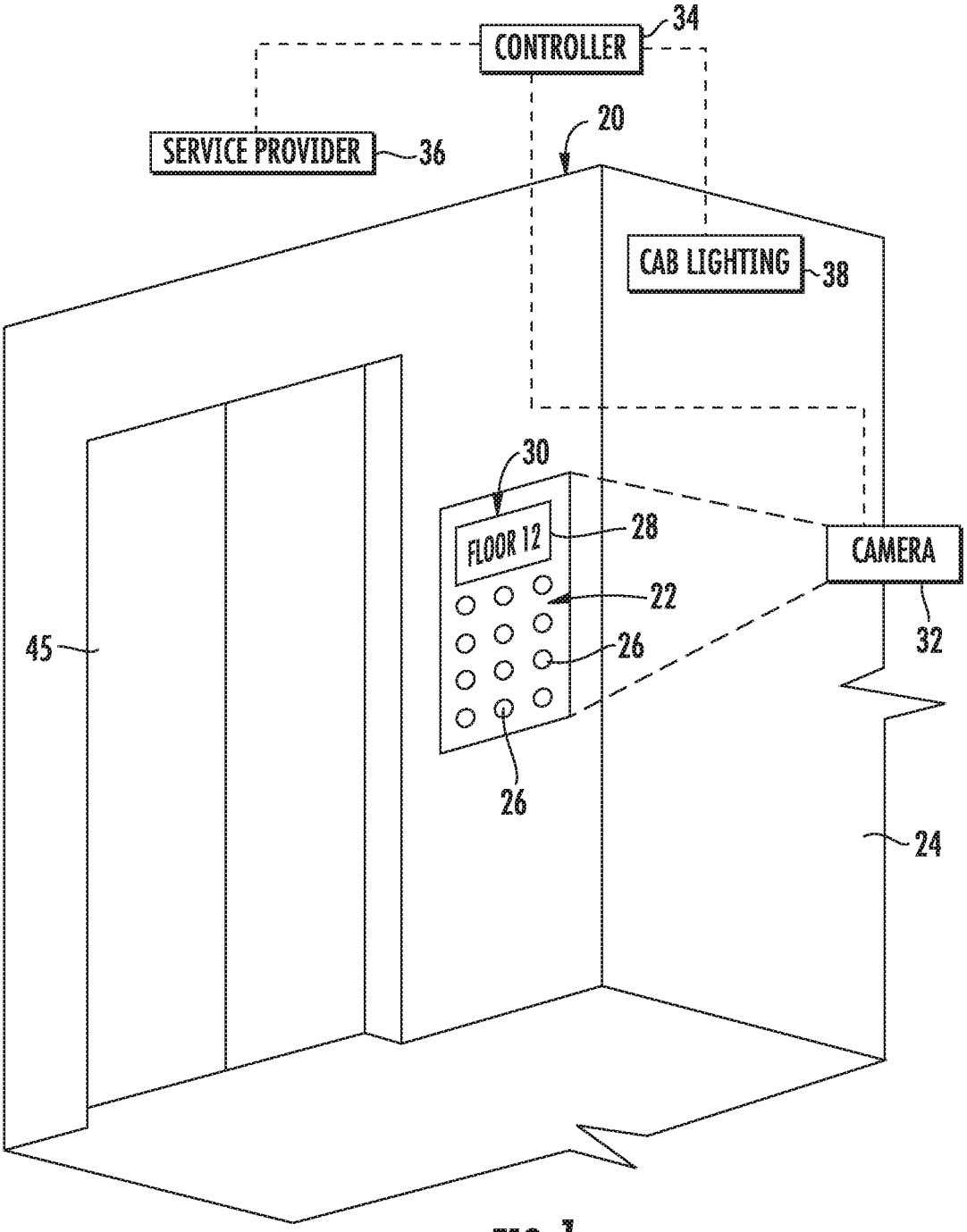
FIG. 1 schematically illustrates selected portions of a system designed according to an embodiment of this invention.

FIG. 1 schematically illustrates a system 20 for determining the condition of a COP 22 in an elevator cab 24. The COP 22 includes a plurality of light sources 26 that may be used for a variety of purposes. In the illustrated example, some of the light sources 26 are associated with floor selection buttons that allow passengers to indicate a desired destination to which they desire to be carried by the elevator system. Others of the light sources are associated with other elevator function indicators on the COP. Examples of indicators of other elevator functions include an indicator of a mode of operation (e.g., a fire service operation), a door open button, a door close button, a message indicator (e.g., "please exit the elevator car"), and a button to request help. Those skilled in the art who have the benefit of this description and an understanding of the types of elevator functions that may be useful to include on a COP will realize how to configure such indicators to meet their particular needs.

The example COP 22 also includes a display 28 that provides a floor or position indication 30. The display 28 may be configured in a variety of ways that can have different types of light sources to provide the floor indication 30. For example, the display 28 may be back lit by one or more light sources. Alternatively, the display 28 may include a plurality of lighted segments that are selectively illuminated to cause the display 28 to show a desired alphanumeric indication to a passenger within the elevator cab 24.

The system 20 includes a camera 32 that is situated within the elevator cab 24 so that the camera 32 may obtain an image of the COP 22 under selected conditions. The system 20 includes a controller 34 that is configured to control the COP 22 and the camera 32. The controller 34 includes at least one computing device, such as a microprocessor or ASIC that is configured to perform the functions of the controller described in this document. The controller 34 is schematically shown for discussion purposes and the way in which the controller is incorporated into the system 20 may vary depending on the particulars of an embodiment. For example, in some embodiments the controller 34 is part of an elevator controller that is responsible for other elevator functions. In other embodiments the controller 34 is a separate device dedicated to the controlling the COP 22 and the camera 32 to obtain images under appropriate conditions. Although a single controller is schematically shown, the controller in some embodiments is realized through more than one computing device or processor. In one embodiment, the COP 22 and the camera 32 are controlled by separate controllers. In some embodiments, the controller 34 is a remotely located computing device such as a cloud server or computer while in other embodiments the controller 34 comprises a mobile computing device.

The controller 34 in one example controls all of the light sources 26 and the light source or sources associated with the display 28 to turn on all of them so they would all be illuminated if they are all functioning properly. In some embodiments the display 28 includes a screen having individually controlled pixels. Turning all of the light sources of such a display screen includes activating all pixels to display a selected color, which may be consistent across the entire screen or have a predetermined pattern, so that a condition of the entire display 28 may be analyzed.

Activating or turning on the light sources may not result in a light source being illuminated because of a failure of the light source or the COP components responsible for providing power to that light source, for example. Therefore, the phrase turning on or activating a light source as used in this description should be understood to refer to placing the light source in an on state even if the light source is not illuminated in that condition. When the light sources are all turned on or in an on state, the controller 34 causes the camera 32 to obtain an image of the COP 22.

The controller 34 in this embodiment is programmed or otherwise properly configured to determine any differences between the actual illumination of the light sources, respectively, and an expected illumination of the light sources. In the event that the controller 34 detects or determines such a difference, the controller 34 provides an indication regarding a condition of the COP 22 including information regarding any of the light sources whose expected illumination differed from the actual illumination within the obtained image. The type of indication may vary to meet the needs of a particular situation. For example, the indication in some embodiments includes a visual image of the condition of the COP 22 or at least of any malfunctioning light sources 26. Other example indications include an identification of the light source or sources that did not have the expected illumination.

In the illustrated example, the controller 34 communicates such an indication to a service provider 36 who can respond to the indication, for example, by scheduling a technician to visit the site of the elevator cab 24 to repair or replace any light source or other component of the COP 22 to ensure that the COP 22 is functioning properly. The indication in some embodiments is provided using known communication techniques to a remote server or through electronic messaging to a preselected addressee.

In the example of FIG. 1, the controller 34 also controls interior cab lighting 38 to facilitate more accurate determinations regarding the condition of the COP 22. In this example, the controller 34 dims the interior cab lighting 38 at the time that the controller 34 turns on all of the light sources of the COP 22 and causes the camera 32 to obtain the image of the COP 22. Having the interior cab lighting dimmed to a desired level, which may be completely off, facilitates better image quality and image information for purposes of diagnosing any faults in the COP 22 illumination.

Figure 2:
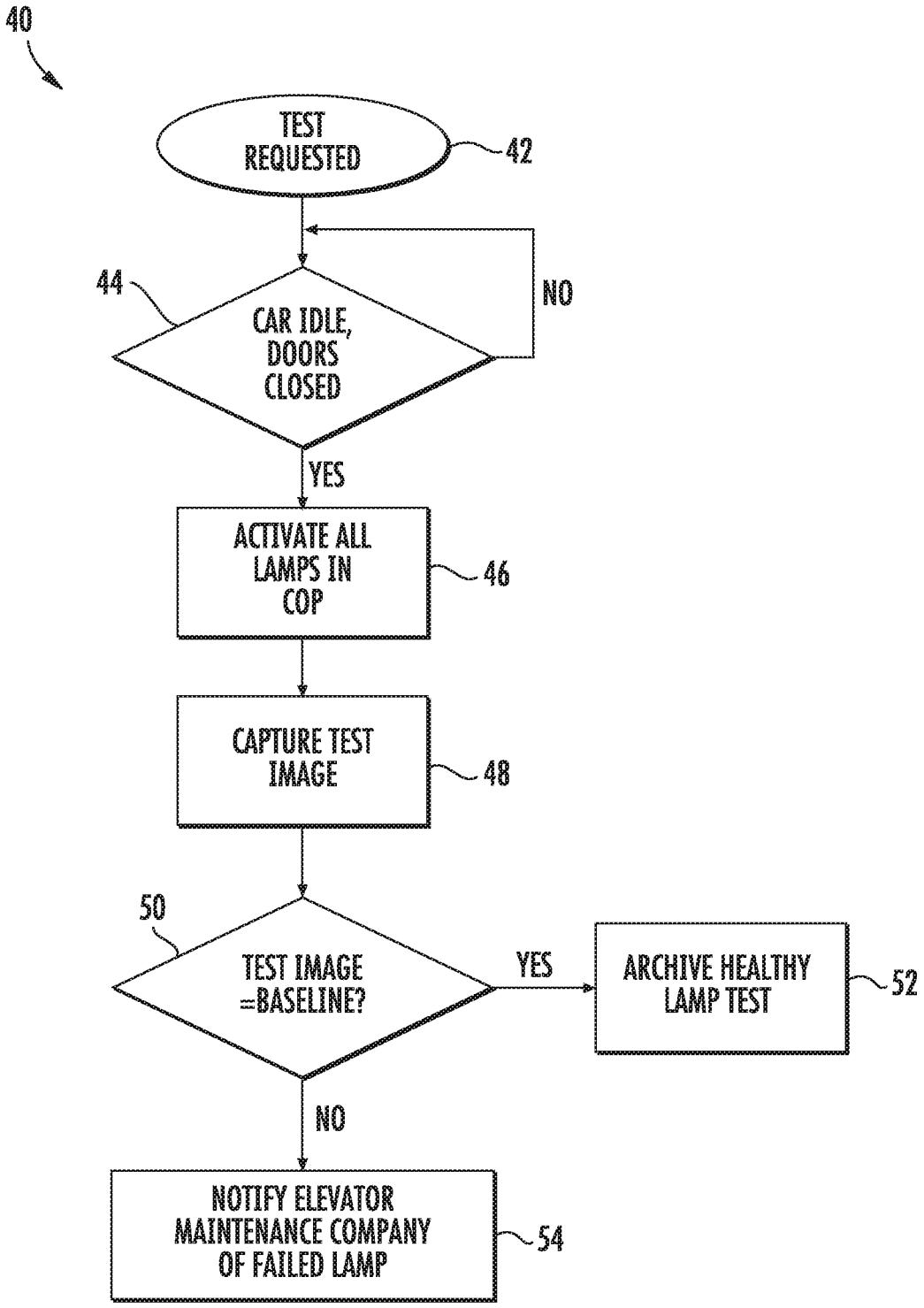
FIG. 2 is a flowchart diagram summarizing an example embodiment of a method designed according to this invention.

FIG. 2 includes a flowchart diagram 40 that summarizes an example approach. At 42, a test is initiated for checking the condition of the light sources 26 of the COP 22. At 44, the controller 34 determines whether the elevator cab 24 is idle and the doors 45 of the cab are closed. Under those conditions, at 46 the controller 34 activates or turns on all lamps or light sources of the COP 22.

At 48, the controller 34 controls the camera 32 to capture an image of the COP 22. At 50, a determination is made whether the actual illumination of the respective light sources of the COP 22 corresponds to an expected illumination of those light sources. In one example, a baseline or reference image of the COP 22 with all light sources properly illuminated serves as a reference for comparing the actual illumination from the obtained image of the COP 22 to the expected illumination. By using known image recognition techniques, the controller 34 determines whether any light source in the obtained image is not illuminated as desired because there is a difference between the expected illumination and the actual illumination of any of the light sources.

In another example, the controller 34 is programmed or otherwise suitably configured to recognize a properly illuminated light source within the obtained image and to compare the appearance of that light source within the image to the appearance of one or more other light sources within the image that have similar characteristics. Such comparisons are made between similar light sources associated with similar features of the COP 22. For example, the controller 34 may determine that there are properly functioning floor selection light sources within a first portion of the obtained image. That information may be used as a baseline or reference for comparison with a second, different portion of the image where similarly configured floor selection light sources are present. Differences between those light sources within the obtained image, itself, are recognized by the controller 34 when such differences exist.

In FIG. 2, when all of the light sources of the COP 22 appear to be functioning properly, an indication is stored at 52 regarding a successful test confirming proper COP operation. In one embodiment, the indication is sent to a mobile device such as a mobile phone, laptop, tablet, smartwatch, or any other known mobile electronic device. In one embodiment, the indication may be sent to a cloud server or other remotely located computing device and/or the mobile device. In the event that at least one of the light sources is not working as desired, the controller 34 provides an indication at 54 including information regarding any of the light sources that is not functioning as desired. In one embodiment, the indication may be provided on a local display or remotely on a mobile device, cloud computer, or any other desired remotely located computing device.

In another example embodiment, the image processing and determinations regarding illumination of the respective light sources are made at a remote location, such as by the service provider 36, rather than by the controller 34. In such an embodiment, the controller 34 or camera 32 transmits or communicates image information to the service provider 36 where the determinations are made regarding the health or condition of the COP 22.

As mentioned above, some embodiments of the COP 22 will include a display 28 that provides a floor or position indication 30 by selectively illuminating a plurality of light segments (e.g., LEDs) to provide a desired alpha-numeric indication. In one such embodiment, the controller 34 turns on all such light segments for purposes of obtaining an image of the COP 22 by the camera 32. In another example embodiment, the light segments of the display 28 corresponding to displaying the current or actual location of the elevator car will be turned on when the camera 32 obtains the image of the COP 22. Information regarding which of the light sources of the display 28 should be illuminated allows for recognizing any malfunctioning light sources or light segments.

Figure 3:
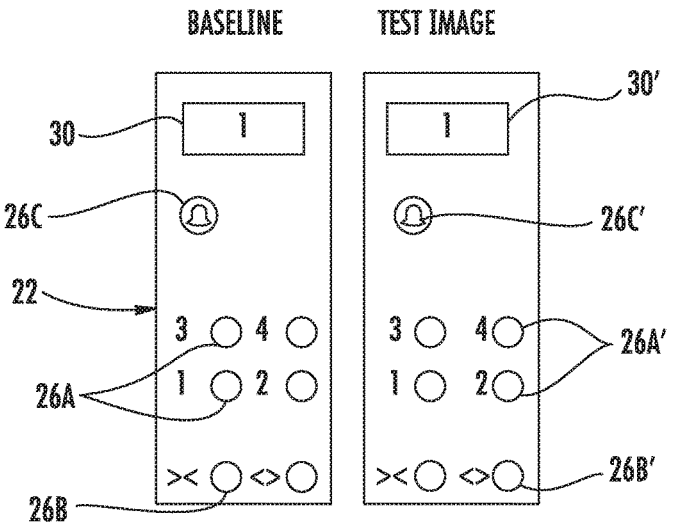
FIG. 3 schematically illustrates a comparison of actual light source illumination conditions to a reference.

FIG. 3 schematically illustrates an example determination regarding a condition of the COP 22. In this example, some of the light sources 26A are associated with floor selection buttons. Other lights sources 26B are associated with other functional buttons of the COP 22, such as a door open or door close button. At least one other light source 26C is associated with an indicator regarding a mode of operation of the elevator. According to FIG. 3, all of the light sources have an actual illumination shown on the right hand side of the illustration that matches or appropriately corresponds to the expected illumination as shown on the left hand side of FIG. 3.

Figure 4:
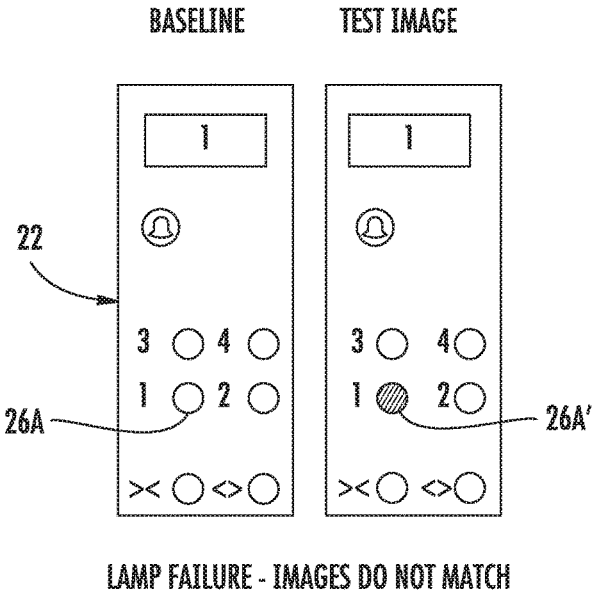
FIG. 4 schematically illustrates another example comparison of actual light source illumination to a reference.

FIG. 4 illustrates another scenario in which the expected illumination is represented on the left hand side of the drawing and the actual illumination or captured image of the COP 22 is represented on the right hand side of the figure. In this example, a light source 26A associated with a floor selection button shown in the image at 26A' is malfunctioning. The actual illumination of the light source 26A' in the image captured by the camera 32 differs from the expected illumination shown on the left at 26A. A determination regarding that difference will be made and appropriate action can be taken, such as scheduling a service technician to attend to the COP 22.

Recognizing which of the light sources in an image is not functioning properly may be accomplished using known video analytics techniques. For example, a relative position within the image may indicate which of the lamps is not working properly. Alternatively, recognizing an indicator on a button associated with the malfunctioning light source provides appropriate information for identifying that light.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A method of determining a condition of an elevator car operating panel, the method comprising:

controlling a plurality of light sources of the car operating panel to turn on all of the plurality of light sources;

obtaining an image of the car operating panel that indicates an actual illumination of all of the light sources, respectively;

determining, from the obtained image, if there are any differences between an expected illumination and the actual illumination of any of the light sources by recognizing the expected illumination of at least one of the light sources in at least a first portion of the obtained image;

comparing at least a second portion of the obtained image to the first portion of the obtained image; and determining whether at least one light source in the second portion has the expected illumination based on the comparing; and providing an indication of the condition of the elevator car operating panel including information regarding any determined differences between the expected illumination and the actual illumination.

2. The method of claim 1, wherein the determining further comprises comparing the obtained image to a reference image; and the reference image indicates the expected illumination of all of the light sources, respectively.

3. The method of claim 1, wherein the at least one light source in the second portion has a similar characteristic to the at least one light source in the first portion.

4. The method of claim 1, wherein the car operating panel comprises a plurality of floor selection indicators;

some of the light sources are associated with the floor selection indicators, respectively;

the car operating panel comprises at least one other elevator function indicator;

at least one of the light sources is associated with the at least one other elevator function indicator;

the car operating panel includes a car position indicator;

some of the light sources are associated with the car position indicator; and controlling all of the light sources comprises turning on the light sources associated with the floor selection indicators, the elevator function indicator and the car position indicator.

5. The method of claim 4, wherein the light sources associated with the car position indicator collectively display a plurality of floor designations based on which of the light sources associated with the car position indicator are illuminated; and controlling the light sources includes one of turning on all of the light sources associated with the car position indicator simultaneously, or turning on only those of the light sources associated with the car position indicator that should be illuminated to indicate a current car position.

6. The method of claim 1, wherein the car operating panel comprises a display screen;

the display screen includes a plurality of pixels; and controlling the light sources includes turning on the pixels.

7. The method of claim 1, comprising dimming lighting in an elevator cab in which the car operating panel is located prior to obtaining the image.

8. The method of claim 1, wherein providing the indication includes identifying any one of the light sources that does not have the expected illumination in the image.

9. The method of claim 1, wherein providing the indication includes initiating a request for a technician to attend to the car operating panel based upon a difference between the expected illumination and the actual illumination for any of the light sources.

10. A system, comprising:

an elevator car operating panel including a plurality of light sources;

a camera situated to obtain an image of the car operating panel, the image indicating an actual illumination of all of the plurality of light sources, respectively; and a controller that is configured to control the plurality of light sources, turn on all of the plurality of light sources, control the camera to obtain the image when all of the light sources are turned on, determine, from the obtained image, if there are any differences between an expected illumination and the actual illumination of any of the light sources by recognizing the expected illumination of at least one of the light sources in at least a first portion of the obtained image;

comparing at least a second portion of the obtained image to the first portion of the obtained image, and provide an indication of the condition of the elevator car operating panel including information regarding any determined differences between the expected illumination and the actual illumination.

11. The system of claim 10, wherein the controller is further configured to determine if there are any differences by comparing the obtained image to a reference image; and the reference image indicates the expected illumination of all of the light sources, respectively.

12. The system of claim 10, wherein the at least one light source in the second portion has a similar characteristic to the at least one light source in the first portion.

13. The system of claim 10, wherein the car operating panel comprises a plurality of floor selection indicators;

some of the light sources are associated with the floor selection indicators, respectively;

the car operating panel comprises at least one other elevator function indicator;

at least one of the light sources is associated with the at least one other elevator function indicator;

the car operating panel includes a car position indicator;

some of the light sources are associated with the car position indicator; and the controller is configured to turn on the light sources associated with the floor selection indicators, the elevator function indicator and the car position indicator.

14. The system of claim 13, wherein the light sources associated with the car position indicator collectively display a plurality of floor designations based on which of the light sources associated with the car position indicator are illuminated; and the controller is configured to control the light sources associated with the car position indicator by turning on all of the light sources associated with the car position indicator simultaneously, or turning on only those of the light sources associated with the car position indicator that should be illuminated to indicate a current car position.

15. The system of claim 10, wherein the car operating panel comprises a display screen;

the display screen includes a plurality of pixels; and the controller is configured to control the light sources by turning on the pixels.

16. The system of claim 10, comprising elevator cab lighting and wherein the controller is configured to dim the elevator cab lighting prior to the camera obtaining the image.

17. The system of claim 10, wherein the controller is configured to provide the indication including identifying any one of the light sources that does not have the expected illumination in the image.

18. The system of claim 10, wherein the controller is configured to initiate a request for a technician to attend to the car operating panel based upon a difference between the expected illumination and the actual illumination for any of the light sources.

* * * * *